US005645892A

United States Patent [19]

Whitley et al.

[11] Patent Number: 5,645,892

[45] Date of Patent: Jul. 8, 1997

[54] METHOD AND COMPOSITIONS FOR PROVIDING AN IMPROVED FINISH FOR BRUSHED OR PILE TEXTILE FABRICS

[75] Inventors: David Anderson Whitley, Rock Hill, S.C.; Carl Lewis Wolhar, Charlotte, N.C.

[73] Assignee: IVAX Industries, Inc., Horsham, Pa.

[21] Appl. No.: 550,742

[22] Filed: Oct. 31, 1995

[51] Int. Cl.[6] ..... B05D 3/02

[52] U.S. Cl. ..... 427/393.4; 427/421; 427/428; 428/96; 428/97; 524/603; 524/604; 528/66; 528/272; 528/296

[58] Field of Search ..... 427/393.2, 393.4, 427/421, 428; 428/96, 97, 265; 524/603, 604; 528/66, 372, 296

[56] References Cited

U.S. PATENT DOCUMENTS

| | | | |
|---|---|---|---|
| 3,557,039 | 1/1971 | McIntyre et al. | 8/115.6 X |
| 4,463,165 | 7/1984 | Engelhardt et al. | 427/393.4 |
| 4,981,905 | 1/1991 | Simons et al. | 524/603 |
| 5,153,297 | 10/1992 | Munzmay et al. | 528/70 |
| 5,306,435 | 4/1994 | Ishikawa et al. | 8/94.1 R |

OTHER PUBLICATIONS

Taub, *Journal of Coated Fabrics,* vol. 12, pp. 105–120 (1982).

ICI Americas, Inc., Milease® Technical Bulletin (Sep. 1994).

*Primary Examiner*—Michael Lusignan

*Attorney, Agent, or Firm*—Kirschstein, Ottinger, Israel & Schiffmiller,PC

[57] ABSTRACT

A method of treating natural or synthetic pile or brushed fabrics to reduce marking caused by rubbing or handling the fabrics, while leaving the fabrics with a soft feel and a full, thick hand. The method consists of the application to the fabrics of liquid compositions comprising a) about 80–100% of a water-dispersible, hydrophilic polyester or polyurethane dispersed in an aqueous medium; b) about 0–20% of a carrier of the type used to enhance the penetration of dyes and other materials into the polymer structure of polyester fibers; and c) about 0–10% of a non-rewetting wetting agent.

22 Claims, No Drawings

METHOD AND COMPOSITIONS FOR PROVIDING AN IMPROVED FINISH FOR BRUSHED OR PILE TEXTILE FABRICS

REFERENCE TO DISCLOSURE DOCUMENT

This application incorporates material included in Disclosure Document No. 375890, filed May 8, 1995.

BACKGROUND OF THE INVENTION

1. Field of the Invention

The invention relates to methods and compositions for providing an improved finish for brushed or pile fabrics, particularly a finish that will decrease marking when the fabrics are rubbed or handled.

2. Description of the Prior Art

Fabrics which have pile, including flocked fabrics and brushed fabrics such as velours, velvets, brushed polyesters and the like, are used in the manufacture of a wide variety of products including, for example, upholsteries for home and automotive use, garments, draperies and carpeting. Most of these fabrics have directional differences, i.e., the fabric pile gives a different appearance (e.g., lighter or darker) when oriented in one direction from the base to the tips of the fibers as opposed to another direction. These directional differences in the pile leads to visible marks or streaks when the fabric is rubbed or handled. Such marks detract from the beauty and uniformity of the fabric appearance and from the appearance of the articles manufactured from the fabric.

No chemical or mechanical treatment is known in the prior art to prevent or even reduce the markings of pile or brushed fabrics while at the same time maintaining or improving the softness and feel of the fabrics and improving other fabric properties. Such treatment methods, and compositions to be used in carrying out such methods, would be highly desirable for use in the textile industry wherein the improvement of fabric appearance and feel without detracting from other fabric characteristics is an important objective.

SUMMARY OF THE INVENTION

It is the object of the present invention to provide a method of treating pile or brushed fabric to eliminate or reduce marking caused by rubbing or handling the fabrics.

It is a further object of the present invention to provide a method as aforesaid which does not impair and actually improves other fabric properties.

It is another object of the present invention to provide a method as aforesaid wherein the treated fabric is soft, has a full hand and a well-ordered pile which is resistant to marking and streaking.

It is yet a further object of the present invention to provide compositions suitable for use in the novel treatment method.

In keeping with these objects and others which will become apparent hereinafter, the present invention resides in a method of treating pile or brushed fabric, whether composed of natural or synthetic fibers, by applying to the fabric a liquid composition comprising a) about 80–100% of a water-dispersible, hydrophilic polyester or polyurethane dispersed in an aqueous medium; b) about 0–20% of a carrier of the type used to enhance the penetration of dyes and other materials into the polymer structure of polyester fibers; and c) about 0–10% of a non-rewetting wetting agent.

The novel method of treatment may be carried out by applying the compositions to the fabric by any conventional means, particularly by pad bath and exhaust and spray applications. Fabrics treated in accordance with the subject method exhibit greatly reduced marking when rubbed or handled, and have a soft feel with a full, thick hand, decreased linting and dirt retention and good anti-static properties.

DETAILED DESCRIPTION OF THE INVENTION

The compositions used in the treatment method of the invention comprise one principal component (hereinafter referred to as the "first component") and, optionally, two additional components (hereinafter referred to respectively as the "second component" and the "third component").

The compositions comprise as the first component about 80–100% by weight, and preferably 90–100%, of a water-dispersible, hydrophilic polymer or oligomer selected from polyesters and polyurethanes, dispersed in an aqueous medium. Block or graft polyester copolymers which are water-dispersible are also suitable for use as the first component. Examples of stable aqueous dispersions of such block or graft copolymers are described in U.S. Pat. No. 3,557,039, the disclosures of which are incorporated herein by reference.

Commercially available water-dispersible polyesters which are well-adapted for use as the first component include, but are not limited to, the following:

POMACO™ SR-92 (Piedmont Chemical)
MILEASE™ HPA (ICI Americas, Inc.)
MILEASE™ T (ICI Americas, Inc.)
NICCATE™ SR-9 (NICCA U.S.A., Inc.)
EV-23™ (EvCo Research Inc.)

Also suitable for use as the first component in the subject composition are water-dispersible polyurethanes, for example those disclosed in Taub, *J. Coated Fabrics,* 12:105–120 (1982), the disclosures of which are incorporated herein by reference.

The second component of the compositions is selected from the group of carriers used to enhance the penetration of dyes and other materials into polyester fibers. This component is present in a weight concentration of about 0–20% and preferably about 2–8% in the composition. The use of the second component enhances the effects of the novel treatment method, particularly in treating synthetic polyester fabric, by increasing the penetration and adsorption of the primary, first component into the fabric fibers.

Examples of carriers or penetration enhancing agents which may be used as the second component include, but are not limited to, the following:

benzoic acid
salicylic acid
methyl salicylate
phenolics
orthophenyl phenol
para phenyl phenol
chlorobenzene
halogenated benzenes
trichlorobenzene
dichlorobenzene
monochlorobenzene
tripropylphosphate
beta naphthol sulfonic acid
beta naphthol
monomethylnaphthalene
O-chlorophenol
N-alkylphthalamide methyl dichlorophenoxyacetate
2,4-dichlorophenol
sulfated naphthalene
methylphenol ethoxylates
butylbenzoate
benzaldehyde
tetrahydronaphthalene with cyclohexanol
methylphenyl carbinol with acetophenone
methyldichlorophenoxy acetate
monochlorophenyl phenol
biphenyl
methyl cresotinate
diallylphthalate The second component may include emulsifiers and other adjuncts in addition to the primary ingredients exemplified above.

The following commercially available carriers are also suitable for use as the second component:

MARKARRY™ 76
MARKARRY™ HEM
MARKARRY™ LO
MARKARRY™ RT
MARKARRY™ SAF
MARKARRY™ ESPT (all made by IVAX Industries, Inc.)

The third component of the compositions is a non-rewetting wetting agent which is present in a weight concentration of about 0–10%, and preferably about 0.25–5.0%.

Any wetting agents known to those skilled in the art of textile chemistry or formulations as non-rewetting wetting agents may be used as the third component in the subject composition. For example, solutions of ethoxylated decyl alcohol may be used. One suitable wetting agent consists of a 20% solution of ethoxylated decyl alcohol (6 moles of ethylene oxide).

The method of the invention comprises the application of compositions as described above to pile, flocked or brushed fabrics including, by way of illustration, velours, velvets and carpeting of natural or synthetic fibers. The fabrics are preferably treated in unsewn form. The compositions may be applied by any known or conventional method for applying liquid treatments or finishes to fabrics, many of which will be apparent to those of skill in the art. By way of example, the compositions may be applied to the fabrics by pad bath or by exhaust or spray application. In some instances the fabric may be soaked in a bath containing the novel compositions. The compositions may also be diluted with water, e.g., for purposes of spray or bath application. However the compositions are applied, to maintain the softness and full hand of the treated materials it is advantageous to dry them as slowly as possible under conditions which do not involve excessive application of heat.

The techniques by which the subject compositions are applied to the fabrics and the subsequent heating or drying procedures are not part of the present invention and may be varied or adapted as deemed suitable for particular commercial or industrial uses.

A sufficient quantity of the treatment composition in diluted or undiluted form should be applied to the fabric to provide in contact with the fabric about 0.5 to about 6.5% of the composition by weight based on the weight of the fabric. The exact quantity to be applied will depend on the nature of the fabric to be treated and its intended use, the desired treatment result and similar factors.

Application of the subject compositions by the means described to brushed or pile fabrics, for example woven or knit polyester velour, velvet, brushed woven wool, cotton corduroy or carpeting fabrics, leaves the fabric pile in a much more ordered arrangement than prior to treatment, and thus enables the fabric to resist marking, streaking and variations in color, shade or appearance which normally results when such fabrics are stroked or rubbed. Moreover, the fabrics treated in accordance with the invention have a fuller feeling, are soft and have an excellent hand. The method of the invention is easy and inexpensive to practice in a commercial setting and greatly improves both the cosmetic appearance and the physical feel and comfort of the treated fabric.

The following are representative examples illustrating the treatment method of the invention and the compositions used therein, as well as the results of testing performed on various fabrics utilizing the method of the invention. These examples are not intended, however, to limit the invention in any way or to set forth specific compositions, components, fabrics or methods of application which must be used exclusively to practice the invention.

EXAMPLE 1

Treatment Composition

A composition for use in the treatment method of the invention was prepared with the following components:

a) 93% by weight MILEASE™ T (ICI Americas, Inc.) nonionic, hydrophilic polyester copolymer in aqueous dispersion;

b) 4.7% by weight of a composition including 85% butylbenzoate and 15% emulsifiers as a carrier and penetrating and flexibilizing agent; and c) 2.3% by weight of a 20% solution of ethoxylated decyl alcohol (6 moles of ethylene oxide).

The above components were thoroughly mixed until a homogeneous mixture/dispersion was obtained.

EXAMPLE 2

Treatment of Finished Polyester Woven Velour Upholstery Fabric

Three 100% polyester woven, acrylic latex backed, velour auto upholstery fabrics were treated with the composition of Example 1 by pad application using four concentrations of the product in the pad bath (2.5, 5.0, 7.5, and 10% based on the weight of the bath). The fabrics were dipped once and run through a squeeze roll to give 65±3% wet pickup. The drying time in a 300° F. Mathis Oven was adjusted to use no more heat than needed to dry the fabric. A standard drying time was established for this fabric of 4 minutes at 300° F.

Evaluation of the treatments was done by several expert personnel and fabric producers familiar with the fabric and the automotive upholstery fabric industry. Their consensus was that the 2.5% bath softened the fabric; the 5.0% made a significant improvement in the fabric appearance and softness; the 7.5% gave the fabric excellent hand and appearance; but the 10% treated fabric was extremely soft and slick and the 10% concentration seemed excessive. A water-only blank was done for comparison.

One of the test fabrics had previously had a Scotchguard FC-248 finish applied to it and the composition of Example 1 still made a significant improvement in fabric properties as stated above.

Other woven velour auto upholstery fabrics have had the composition of Example 1 applied at 10% pad bath concentration with excellent results.

EXAMPLE 3

Treatment of Unfinished Velour Upholstery Fabric

The composition of Example 1 was applied to three 100% polyester woven velour auto upholstery fabrics without any backcoating. The three styles included a bright red with a darker orange brown tiger stripe, a royal blue with small multicolored dots and a light beige with a mingled subtle multicolored random type pattern. These fabrics differed from the fabrics tested in Example 2 which were finished goods, while these fabrics were only split. These pile fabrics were made with two warps and a loose pile filling to give the pile. After being woven, the fabric was split to make two pieces of fabric from one leaving about half of the pile on either side. It is at this point in construction where our samples were taken. In production, the fabric would be sheared to make the pile more even, brushed lightly, back coated (possible fluorochemical treated), dried/cured and brushed heavily. This makes the results obtained with the treatment of the invention and no mechanical treatment even more impressive.

To these three fabrics were applied 5.0% and 7.5% concentrations of the composition of Example 1 by pad method, and the fabrics were then dried at 300° F. for 2 minutes, to compare the results to previous testing done on backcoated fabric. The fabric appearance was greatly improved in all three cases with the fabric feeling fuller and the pile in a much more ordered arrangement and very soft.

To facilitate adoption of the composition of Example 1 into plant production, spray application was tried on all three fabrics. A 10% dilution in water of the composition of Example 1 was used. Different percent add-on was obtained by the amount applied. The following table outlines certain application parameters and the results as to effects on crock ratings of the fabrics. This work was done on the blue style. The percentage concentrations given in the table reflect the concentration of the undiluted composition sprayed on the fabric based on the weight of the fabric (owf).

TABLE 1

| Sample Number | % of Composition of Example 1 (owf) | Drying Conditions | Results |
|---|---|---|---|
| 1 | 1.93 | 2 min. at 300° F. | hurt crock ratings |
| 2 | 2.86 | 2 min. at 300° F. | hurt crock ratings |
| 3 | 2.64 | 1.5 min. at 275° F. | acceptable crock |
| 4 | 2.64 | 2 min. at 250° F. | crock as received |
| 5 | 2.64 | 2 min. at 225° F. | crock as received |
| 6 | 2.64 | Tumble Drier | crock as received |

These tests show that any drying at 300° F. lowers the crock rating both wet and dry. However, this was not the case when the fabrics were dried at 275° F. or below. The sprayed fabrics had very nice hand and greatly improved appearance comparable to those which had the composition of Example 1 applied by the pad method. This spray method with drying at 250° F. for 2 minutes was used on the red/orange style with very good appearance and hand improvement with no worse crock than as received.

SUMMARY OF RESULTS ON WOVEN VELOUR FABRIC

The overall evaluation of the fabrics testing the composition of Example 1 was that the appearance was greatly improved with the fabric feeling fuller and the pile in a much more ordered arrangement and very soft. The spray application method was as effective on this fabric as the pad method and has two advantages. It allows less product to be applied which accommodates milder drying conditions to run at faster production speeds with an economic advantage of using about half the amount of the composition of Example 1 since the product is applied to the face of the fabric, which is where it is desired.

EXAMPLE 4

Treatment of Polyester Knit Velour Upholstery Fabric

The composition of Example 1 was applied to numerous different 100% polyester knit velour auto upholstery fabrics all with good results (i.e., improved hand and fabric appearance). The composition of Example 1 was applied by exhaust, pad and spray methods. The quantity of product used is very similar to that used on woven fabric above.

In addition to laboratory investigations three large scale evaluations of the composition of Example 1 on two different types of brushed 100% polyester knit automotive fabric were carried out. The application was from a pad bath at 8, 12 and 14% based on the bath weight. The fabric was tested and passed all requirements and expectations, including a series of tests known as Toyota Spec: TSL 2610G. These evaluations were done to see the effect of the composition of Example 1 on two types of brushed fabric. Both treated fabrics had significantly improved properties.

EXAMPLE 5

Treatment of Polyester and Cotton Velvets

The composition of Example 1 was applied to 100% polyester and 100% cotton velvet by pad bath method at 5, 8 and 14% based on the weight of the bath. The treatment with the composition of Example 1 gave a much fuller hand and improved appearance than prior to the application. In each case the fabric was made to look and feel like a much more expensive fabric.

EXAMPLE 6

Treatment of Wool Woven Fabrics

The composition of Example 1 was applied by pad method to 100% wool woven fabric which had been brushed. The pad bath was 5% by weight of the composition of Example 1 and the fabric was dried for 2 minutes at 180° F. The fabric after the application had a much fuller hand and appearance (felt thicker) and had a much richer shade.

EXAMPLE 7

Treatment of Cotton Corduroy Fabric

The composition of Example 1 was applied to 100% cotton corduroy fabric by pad application at 4 and 10% based on the weight of the bath. The fabric had a softer hand and a better appearance than without the treatment. The fabric appearance was a richer tone without the whitish surface appearance which is often observed with this type of fabric construction.

Apart from the specific improvements in appearance, feel and other physical properties of the treated fabrics noted in Examples 2–7, all of the treated fabrics showed considerably increased resistance to marking, streaking and shade variation when stroked or rubbed.

It has thus been shown that there are provided methods and compositions which achieve the various objects of the invention and which are well adapted to meet the conditions of practical use.

As various possible embodiments might be made of the above invention, and as various changes might be made in the embodiments set forth above, it is to be understood that all matters herein described are to be interpreted as illustrative and not in a limiting sense.

What is claimed as new and desired to be protected by Letters Patent is set forth in the following claims.

We claim:

1. A method of treating pile or brushed fabric to decrease marking and streaking when the fabrics are stroked, rubbed or handled and to improve the softness and hand of the fabrics, said method comprising the application to the fabric of a liquid composition containing by weight:

a) about 80–100% of a water-dispersible, hydrophilic polyester or polyurethane dispersed in an aqueous medium;

b) about 0–20% of a carrier of the type used to enhance the penetration of dyes and other materials into the polymer structure of polyester fibers; and c) about 0–10% of a non-rewetting wetting agent.

2. A method according to claim 1 wherein said composition includes about 90–100% of the hydrophilic polyester or polyurethane dispersion.

3. A method according to claim 1 wherein said composition includes about 2–8% of the carrier.

4. A method according to claim 1 wherein said composition includes includes about 0.25–5.0% of the wetting agent.

5. A method according to claim 1 wherein the fabric is selected from the group consisting of finished or unfinished polyester woven velour, polyester knit velour, polyester and cotton velvets, wool woven fabrics, cotton corduroy and carpeting fabrics.

6. A method according to claim 1 wherein said liquid composition is applied to the fabric by pad bath or exhaust or spray application.

7. A method according to claim 1 wherein a sufficient quantity of the composition is applied to the fabric to provide in contact with the fabric about 0.5–6.5% of the composition by weight based on the weight of the fabric.

8. A method according to claim 1 wherein said hydrophilic polyester is a block or graft polyester copolymer.

9. A method according to claim 1 wherein said carrier comprises benzoic acid, salicylic acid, methyl salicylate, phenolics, orthophenyl phenol, para phenyl phenol, chlorobenzene, halogenated benzenes, trichlorobenzene, dichlorobenzene, monochlorobenzene, tripropylphosphate, beta naphthol sulfonic acid, beta naphthol, monomethylnaphthalene, O-chlorophenol, N-alkylphthalamide, methyl dichlorophenoxyacetate, 2,4-dichlorophenol, sulfated naphthalene, methylphenol ethoxylates, butylbenzoate, benzaldehyde, tetrahydronaphthalene with cyclohexanol, methylphenyl carbinol with acetophenone, methyldichlorophenoxy acetate, monochlorophenyl phenol, biphenyl, methyl cresotinate or diallylphthalate.

10. A method according to claim 9 wherein said carrier additionally comprises emulsifiers.

11. A method according to claim 10 wherein said carrier comprises 85% butylbenzoate and 15% emulsifiers.

12. A method according to claim 1 wherein said wetting agent is a solution of ethoxylated decyl alcohol.

13. A method according to claim 12 wherein said wetting agent consists of a 20% solution of ethoxylated decyl alcohol (6 moles of ethylene oxide).

14. A method according to claim 1 wherein said composition includes about 93% of a nonionic, hydrophilic polyester copolymer in aqueous dispersion; about 4.7% by weight of a composition including 85% butylbenzoate and 15% emulsifiers as a carrier and penetrating and flexibilizing agent; and about 2.3% by weight of a 20% solution of ethoxylated decyl alcohol (6 moles of ethylene oxide).

15. A composition for use in treating pile or brushed fabric to decrease marking and streaking when the fabrics are stroked, rubbed or handled and to improve the softness and hand of the fabrics, said composition containing by weight:

a) about 90–100% of a water-dispersible, hydrophilic polyester or polyurethane dispersed in an aqueous medium;

b) about 2–8% of a carrier of the type used to enhance the penetration of dyes and other materials into the polymer structure of polyester fibers; and c) about 0.25–5.0% of a non-rewetting wetting agent.

16. A composition according to claim 15 wherein said hydrophilic polyester is a block or graft polyester copolymer.

17. A composition according to claim 15 wherein said carrier comprises benzoic acid, salicylic acid, methyl salicylate, phenolics, orthophenyl phenol, para phenyl phenol, chlorobenzene, halogenated benzenes, trichlorobenzene, dichlorobenzene, monochlorobenzene, tripropylphosphate, beta naphthol sulfonic acid, beta naphthol, monomethylnaphthalene, O-chlorophenol, N-alkylphthalamide, methyl dichlorophenoxyacetate, 2,4-dichiorophenol, sulfated naphthalene, methylphenol ethoxylates, butylbenzoate, benzaldehyde, tetrahydronaphthalene with cyclohexanol, methylphenyl carbinol with acetophenone, methyldichlorophenoxy acetate, monochlorophenyl phenol, biphenyl, methyl cresotinate and diallylphthalate.

18. A composition according to claim 17 wherein said carrier additionally comprises emulsifiers.

19. A composition according to claim 18 wherein said carrier comprises 85% butylbenzoate and 15% emulsifiers.

20. A composition according to claim 15 wherein said wetting agent is a solution of ethoxylated decyl alcohol.

21. A composition according to claim 20 wherein said wetting agent consists of a 20% solution of ethoxylated decyl alcohol (6 moles of ethylene oxide).

22. A composition according to claim 15 wherein said composition includes about 93% of a nonionic, hydrophilic polyester copolymer in aqueous dispersion; about 4.7% by weight of a composition including 85% butylbenzoate and 15% emulsifiers as a carrier and penetrating and flexibilizing agent; and about 2.3% by weight of a 20% solution of ethoxylated decyl alcohol (6 moles of ethylene oxide).

* * * * *